US008899136B2

(12) United States Patent
Zhu et al.

(10) Patent No.: US 8,899,136 B2
(45) Date of Patent: Dec. 2, 2014

(54) PUNCHING DEVICE

(75) Inventors: Xiao-Gang Zhu, Shenzhen (CN); Zhao-Qian Zhang, Shenzhen (CN); Wei Huang, Shenzhen (CN); Feng Wu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 252 days.

(21) Appl. No.: 13/550,790

(22) Filed: Jul. 17, 2012

(65) Prior Publication Data

US 2013/0081527 A1 Apr. 4, 2013

(51) Int. Cl.
*B26D 5/08* (2006.01)

(52) U.S. Cl.
USPC ..... 83/564; 83/524; 83/632

(58) Field of Classification Search
USPC ..... 83/564, 632, 524, 566, 646, 647
See application file for complete search history.

(56) References Cited

U.S. PATENT DOCUMENTS

| | | | | | |
|---|---|---|---|---|---|
| 41,861 | A * | 3/1864 | Renfrew | 83/634 |
| RE17,079 | E * | 9/1928 | Hahn | 83/623 |
| 3,302,504 | A * | 2/1967 | Fisher | 83/564 |
| 5,172,622 | A * | 12/1992 | Sabin | 83/520 |
| 5,255,587 | A * | 10/1993 | Eichenberg et al. | 83/628 |
| 6,789,593 | B1 * | 9/2004 | Aono et al. | 156/513 |
| 6,997,092 | B2 * | 2/2006 | Lin | 83/588 |
| 7,124,924 | B2 * | 10/2006 | Marks | 227/120 |
| 7,434,508 | B2 * | 10/2008 | Corcoran et al. | 100/291 |
| 8,122,805 | B2 * | 2/2012 | Liu | 83/687 |
| 2007/0221699 | A1 * | 9/2007 | Hsu | 227/134 |
| 2014/0157967 | A1 * | 6/2014 | Zhang, Charlie | 83/564 |

* cited by examiner

*Primary Examiner* — Sean Michalski
(74) *Attorney, Agent, or Firm* — Novak Druce Connolly Bove + Quigg LLP

(57) ABSTRACT

A punching device includes a base, a linkage assembly, a carrying assembly, a punch and a pressure arm. The linkage assembly includes a pair of linkage members, a rotating member, a first connecting rod, a second connecting rod and a third connecting rod. The rotating member is rotatably mounted on the supporting member, the pair of linkage members is movably mounted on the rotating member, the first, the second and the third connecting rods connects in turn. The carrying assembly is rotatably connected to the third connecting rod and movably supported by the loading member. The punch is mounted on an end of the rotating member. The pressure arm is rotatably connected to the supporting member and the pair of linkage members to drives the carrying assembly to position a workpiece and the punch to punch the workpiece.

20 Claims, 5 Drawing Sheets

PUNCHING DEVICE

BACKGROUND

1. Technical Field

The present disclosure relates to machining devices, and particularly to a punching device with a pre-positioning function capability.

2. Description of Related Art

Punching devices are employed to punch or stamp workpieces. Punching devices include a base, a pressure arm, a linkage assembly and a punch. The linkage assembly is rotatably connected to the base and the pressure arm. The punch is connected to the linkage assembly. The linkage assembly is rotated around the base by the pressure arm, and drives the punch to punch a workpiece. However, a workpiece to be punched should be positioned by a manipulator before punching, thus resulting in lower productivity.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
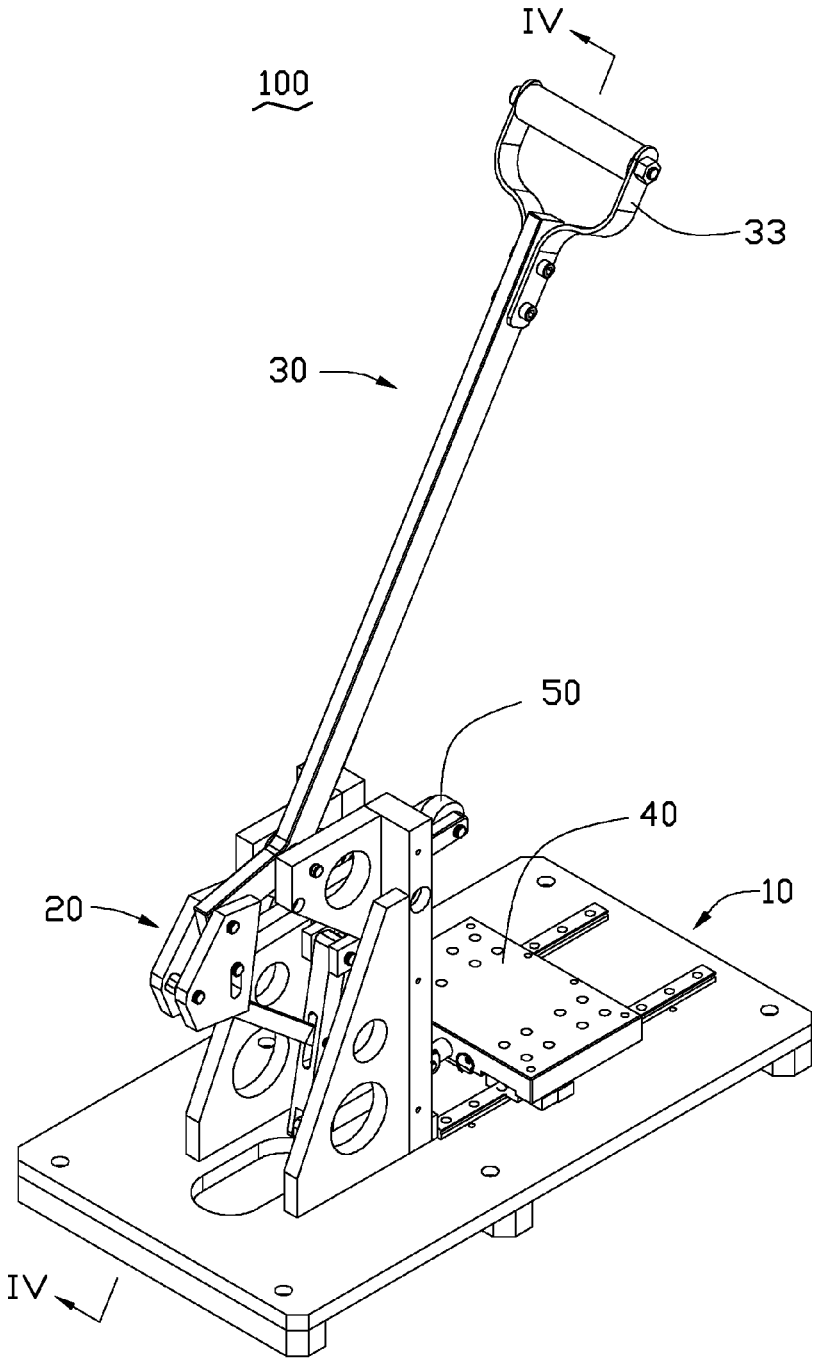
FIG. 1 is an isometric, assembled view of an embodiment of a punching device including a carrying assembly.
Figure 2:
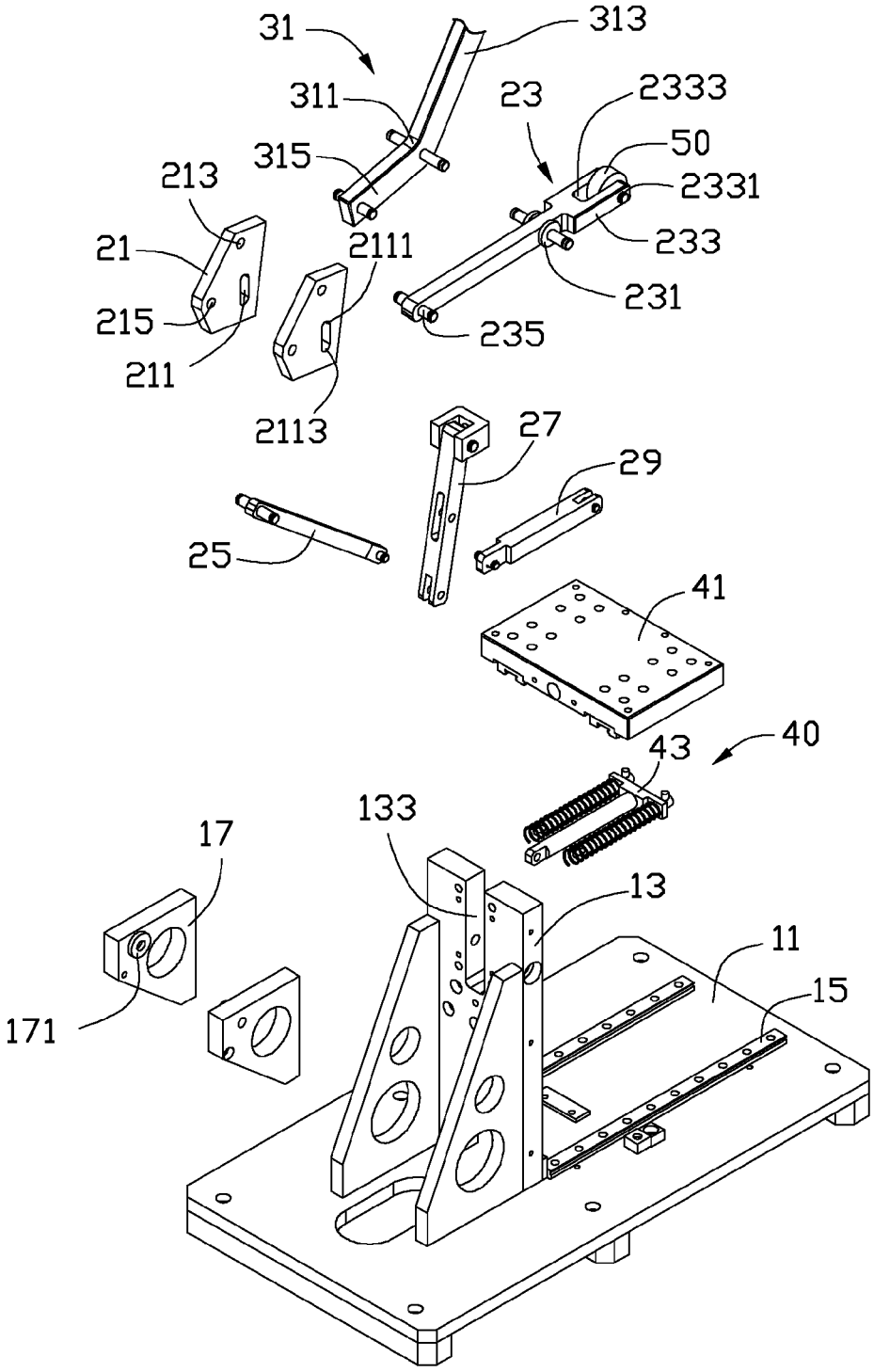
FIG. 2 is an isometric, exploded view of the punching device of FIG. 1.

FIGS. 1 and 2, illustrate an embodiment of a punching device 100. The punching device 100 includes a base 10, a linkage assembly 20, a pressure arm 30, a carrying assembly 40 and a punch 50.

The base 10 includes a loading member 11 and a supporting member 13 mounted on the loading member 11. The linkage assembly 20 is movably mounted on the supporting member 13. The linkage assembly 20 includes a pair of linkage members 21, a rotating member 23, a first connecting rod 25, a second connecting rod 27 and a third connecting rod 29. The rotating member 23 is rotatably mounted on the supporting member 13, the pair of linkage members 21 is movably mounted on an end of the rotating member 23. The first connecting rod 25 is rotatably connected to the pair of linkage members 21 at an end of the first connecting rod 25. The other end of the first connecting rod 25 is connected to a middle portion of the second connecting rod 27. The second connecting rod 27 is rotatably connected at opposite ends thereof to the supporting member 13 and the third connecting rod 29, respectively. The pressure arm 30 is rotatably connected to the supporting member 13 and the pair of linkage members 21. The carrying assembly 40 is rotatably connected to the third connecting rod 29 and movably supported by the loading member 11. The punch 50 is mounted on an end of the rotating member 23 and is driven by the rotating member 23 to punch the workpieces.

The base 10 further includes a pair of guiding rails 15 and a pair of fixing members 17. The loading member 11 is substantially a rectangular plate. The supporting member 13 is perpendicular mounted on the loading member 11 and defines a first opening 131 (referring to FIG. 4) and a second opening 133 at opposite ends of the supporting member 13. The first opening 131 and the second opening 133 cut through opposite end surfaces of the supporting member 13, respectively. The first opening 131 faces the loading member 11. Each of the guiding rails 15 are arranged parallel to each other, and mounted on the loading member 11 adjacent to the supporting member 13. The pair of guiding rails 15 is located adjacent to one side of the first opening 131. Each of the pair of guiding rails 15 is connected to the supporting member 13 by an end thereof. The pair of fixing members 17 is mounted on a top surface of the supporting member 13 opposite to the pair of guiding rails 15. Each fixing member 17 includes a fixing portion 171 away from the loading member 11.

The pair of linkage members 21 is parallel to each other. Each linkage member 21 is a polygon plate, and defines a sliding groove 211, a first linkage hole 213 and a second linkage hole 215. Among the sliding groove 211, the first linkage hole 213 and the second linkage hole 215, the first linkage hole 213 is located away from the loading member 11, and the second linkage hole 215 is located away from the supporting member 13. The sliding groove 211 is an elongated oval shaped. The sliding groove 211 includes a containing portion 2111 and a resisting portion 2113 at opposite ends thereof. The first linkage hole 213 and the second linkage hole 215 are a plurality of round through holes.

The rotating member 23 is rod-shaped and passes through the second opening 133 of the supporting member 13. The rotating member 23 includes a pivot portion 231, a driving end 233, and a linkage end 235. The driving end 233 and the linkage end 235 extend from opposite ends of the pivot portion 231. A distance between the pivot portion 231 and an end portion of the linkage end 235 is greater than a distance between the pivot portion 231 and an end portion of the driving end 233. The pivot portion 231 is rotatably mounted on a middle portion the second opening 133. The driving end 233 includes a pair of bars 2331 parallel to each other, and defines a notch 2333 between the pair of bars 2331. The linkage end 235 is slidably sandwiched between the pair of linkage members 21 and movably received in the sliding grooves 211. A profile of the sliding groove 211 overlaps a trace of the linkage end 235 rotating around the pivot portion 231. In the embodiment, the distance between the pivot portion 231 and an end portion of the linkage end 235 is twice of the distance between the pivot portion 231 and the end portion of the driving end 233.

The first connecting rod 25, the second connecting rod 27, the third connecting rod 29 are bar shaped. An end of the first connecting rod 25 is sandwiched between the pair of linkage members 21 and rotatably mounted in the second linkage hole 215. The other end of the first connecting rod 25 is rotatably connected to a middle portion of the second connecting rod 27. An end of the second connecting rod 27 is rotatably connected to the supporting member 13. The other end of the second connecting rod 27 extends toward the loading member 11. The third connecting rod 29 extends through the first opening 131 of the supporting member 13. An end of the third connecting rod 29 is rotatably connected to an end of the second connecting rod 27. The other end of the third connecting rod 29 is rotatably connected to the carrying assembly 40.

The pressure arm 30 is rotatably mounted on the pair of fixing portions 171. The pressure arm 30 includes a drive rod 31 and a handle 33 fixed to the drive rod 31. The drive rod 31 includes a rotating portion 311, a drive portion 313, and an exerting portion 315 at opposite ends of the rotating portion 311. The drive portion 313 and the exerting portion 315 cooperatively define an obtuse angle. A distance between the rotating portion 311 and an end of the drive portion 313 is greater than a distance between the rotating portion 311 and an end of the exerting portion 315. The rotating portion 311 is rotatably mounted on the pair of fixing members 17. The exerting portion 315 is mounted between the pair of linkage members 21 and rotatably mounted on the first linkage hole 213. The handle 33 is in a buckle shape and fixed to the drive portion 313. In the embodiment, the distance between the rotating portion 311 and an end of the drive portion 313 is about 7.5 times of the distance between the rotating portion 311 and an end of the exerting portion 315.

Figure 3:
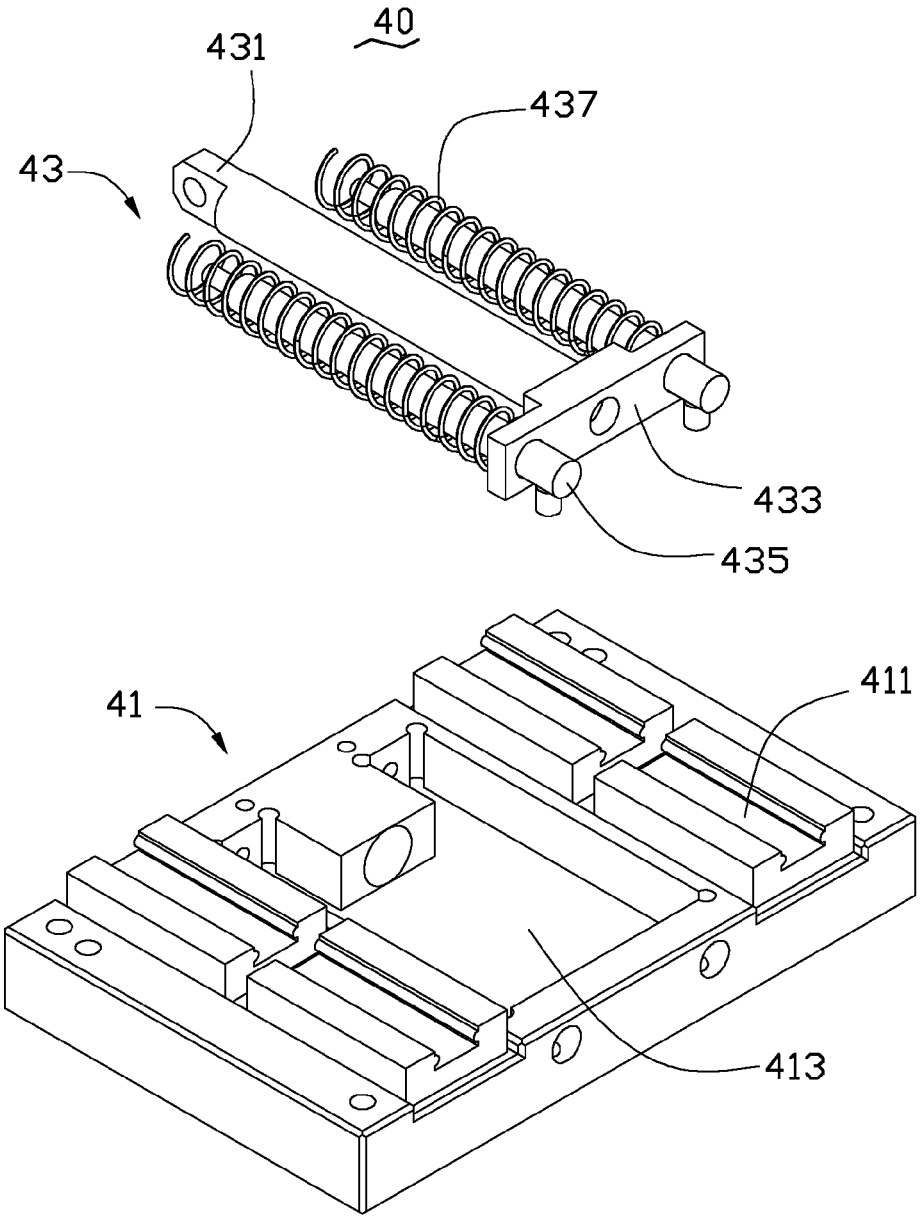
FIG. 3 is an isometric, exploded view of the carrying assembly of the punching device of FIG. 1.

Also referring to FIGS. 2 and 3, the carrying assembly 40 includes a carrying block 41 and a resilient module 43 received within the carrying block 41. The carrying block 41 is substantially a rectangular block, and defining a pair of guiding grooves 411 and a receiving space 413 between the pair of guiding grooves 411. The resilient module 43 includes a dragging rod 431, a connecting member 433, a pair of pushing rods 435, and a pair of resilient members 437. The connecting member 433 is substantially rod shaped. The dragging rod 431 is arranged in the middle of the receiving space 413. A distal end of the dragging rod 431 passes through the carrying block 41 and finally rotatably connects to the third connecting rod 29. The opposite end of the dragging rod 431 is perpendicularly connected to a middle portion of the connecting member 433. The pair of pushing rods 435 is arranged at two sides of the dragging rod 431 and are parallel to each other. An end of the pushing rod 435 is connected to the connecting member 433. The other end of the pushing rod 435 movably passes through the carrying block 41. The pair of resilient members 437 is respectively sleeved on the pair of pushing rods 435. Opposite ends of each resilient member 437 resists the connecting member 433 and the carrying block 41.

The punch 50 is rotatably mounted in the notch 2333 of the rotating member 23. The punch 50 may be a cutter or a pressing mold, for example.

Also referring to FIGS. 1 through 3, when in assembly, the supporting member 13 is mounted substantially perpendicular on the loading member 11. The pair of the guiding rails 15 are located at opposite sides of the first opening 131 and mounted on the loading member 11. The pair of fixing members 17 is fixed to the supporting member 13, and located at opposite sides of the second opening 133. The handle 33 is fixed to the drive rod 31 and the drive rod 31 is rotatably mounted on the pair of fixing members 17. The rotating member 23 is rotatably mounted on the second opening 133 via the pivot portion 231. The punch 50 is rotatably mounted in the notch 2333 of the rotating member 23. The pair of pushing rods 435 is arranged at two sides of the dragging rod 431. The connecting member 433 is fixed to the pair of pushing rods 435 and the dragging rod 431. The pair of resilient members 437 is respectively sleeved on the pair of pushing rods 435. The resilient module 43 is received in the receiving space 413 of the carrying block 41. An end of the dragging rod 431 extends out of the carrying block 41. The pair of guiding rails 15 is received in the pair of guiding grooves 411, and then the carrying assembly 40 is mounted on the loading member 11. The third connecting rod 29 extends through the first opening 131 and rotatably connects to the dragging rod 431. The third connecting rod 29 is rotatably connected to the second connecting rod 27 at an end thereof. The other end of the second connecting rod 27 is rotatably connected to the supporting member 13. An end of the first connecting rod 25 is located between the pair of linkage members 21, and rotatably mounted in the second linkage holes 215. The other end of the linkage member 21 is rotatably connected to a middle portion of the second connecting rod 27. The exerting portion 315 of the drive rod 31 is rotatably mounted in the first linkage holes 213. The linkage end 235 is movably mounted in the sliding groove 211 adjacent to the containing portion 2111, thus the assembling of the punching device 100 is accomplished, and the punching device 100 is operating in a first state.

Figure 4:
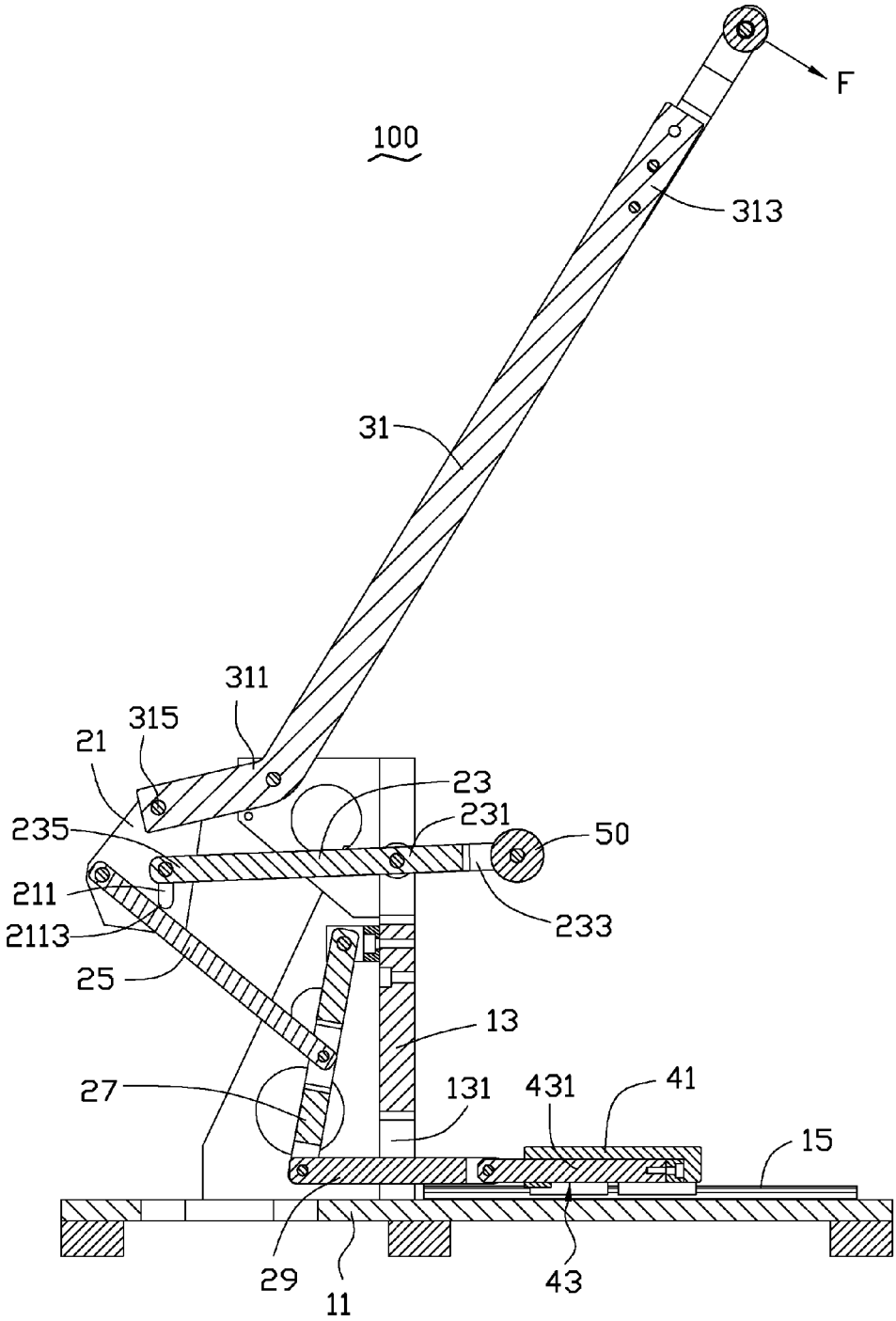
FIG. 4 is a sectional-view of the punching device of FIG. 1 operating in a first state, taken along line IV-IV.
Figure 5:
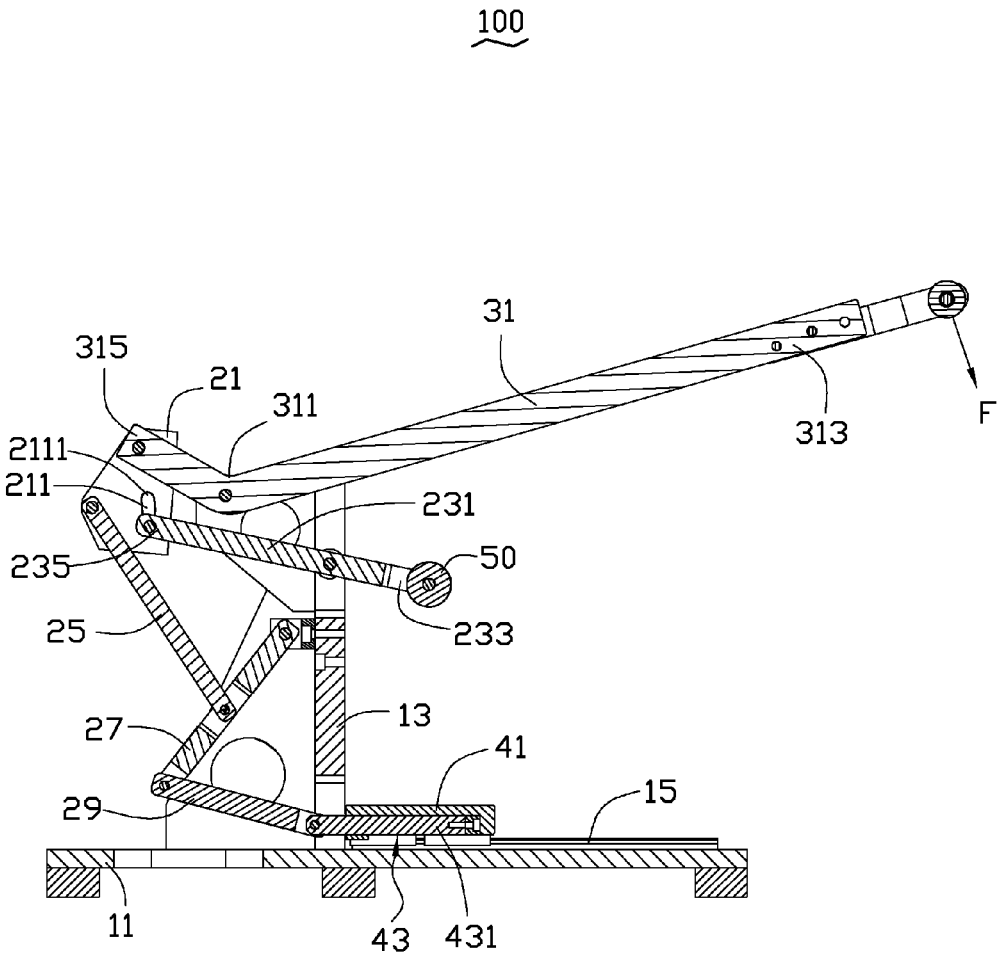
FIG. 5 is similar as FIG. 4, but showing the punching device in a second state.

Also referring to FIGS. 4 and 5, when operating in a working state, a workpiece for punching is placed on the carrying block 41. An external pressing force F is applied to the drive portion 313. The pair of linkage members 21 is rotated by the exerting portion 315 and moves away from the loading member 11. The pair of linkage members 21 drives the second connecting rod 27 to rotate around the supporting member 13 via the first connecting rod 25. An end of the second connecting rod 27 moves away from the loading member 11 and drives the third connecting rod 27 to move. Then the third connecting rod 27 pulls the carrying assembly 40 to slide toward the supporting member 13. The carrying assembly 40 abuts against the supporting member 13 and stops to position the pre-punch workpiece. In the above-described process, the rotating member 23 moves relative to the pair of linkage members 21 adjustably, that is, the linkage end 235 of the rotating member 23 slides from the containing portion 2111 to the resisting portion 2113. When the pre-punch workpiece is positioned, the linkage end 235 resists the resisting portion 2113. While maintaining the exertion of the force F, of the exerting portion 315, the pair of linkage members 21 moves away from the loading member 11. The pair of linkage members 21 drives the resilient module 43 to move relative to the carrying block 41 via the first connecting rod 25, the second connecting rod 27 and the third connecting rod 29. At the same time, the pair of linkage members 21 drives the linkage end 235 to move via the resisting portion 2113. Thus the rotating member 23 rotates around the pivot portion 231 and drives the punch 50 to move toward the pre-punch workpiece; then the punch 50 punches the pre-punch workpiece, and thus the punching device 100 is then operating in a second state.

The punching device 100 employs the linkage member 21, the rotating member 23, the first connecting rod 25, the second connecting rod 27, the third connecting rod 29 and the carrying assembly 40 to pre-position a workpiece automatically; and then, the punching device 100 punches the workpiece via the punch 50, thus the productivity of the punching device 100 is increased. Furthermore, the distance between the pivot portion 231 and an end portion of the linkage end 235 is greater than the distance between the pivot portion 231 and an end portion of the driving end 233. In addition, the distance between the rotating portion 311 and an end of the drive portion 313 is greater than the distance between the rotating portion 311 and an end of the exerting portion 315, thus the punching device 100 offers also labor saving mechanical features. The resilient module 43 is capable of avoiding a collision between the carrying block 41 and the supporting member 13.

It should be noted that the carrying block 41 may be connected to the third connecting rod 29 directly in an another embodiment, and the resilient module 43 may be omitted. In the another embodiment, the pair of linkage members 21 drives the rotating member 23 to rotate, meanwhile, the carrying assembly 40 moves and the punch 50 punches the workpiece while operating in a moving state.

The punching device 100 may employ one of the pair of guiding rails 15 and one of the pair of fixing members 17. The drive portion 313 and the exerting portion 315 may be configured in a straight line.

In some embodiments, the number of the linkage members 21 may be one, the exerting portion 315 of the drive rod 31 is rotatably mounted on a side of the linkage member 21 via the first linkage hole 213. The linkage end 235 of the rotating member 23 and the first connecting rod 25 are rotatably connected to the linkage member 21 in the same way.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A punching device, comprising:

a base comprising a loading member and a supporting member mounted on the loading member;

a linkage assembly comprising a pair of linkage members, a rotating member, a first connecting rod, a second connecting rod and a third connecting rod, wherein the rotating member is rotatably mounted on the supporting member, the pair of linkage members is movably mounted on the rotating member, a first end of the first connecting rod is rotatably connected to the pair of linkage members, a second end of the first connecting rod opposite to the first end thereof is rotatably connected to a middle portion of the second connecting rod, the second connecting rod is rotatably connected to the supporting member and the third connecting rod by opposite ends thereof;

a carrying assembly rotatably connected to the third connecting rod and movably supported by the loading member;

a punch mounted on an end of the rotating member; and a pressure arm rotatably connected to the supporting member and the pair of linkage members, wherein when an external pressing force is applied to the pressure arm to rotate, the pressure arm drives the carrying assembly to position a workpiece via the linkage assembly, and the rotating member rotates to drive the punch to punch the workpiece.

2. The punching device of claim 1, wherein the rotating member comprises a pivot portion, a driving end and a linkage end extending from opposite ends of the pivot portion, the pivot portion is rotatably mounted on the supporting member, the linkage end is movably connected to the pair of linkage members, the punch is mounted on the driving end.

3. The punching device of claim 2, wherein the driving end comprises a pair of bars parallel to each other and defines a notch therebetween, the punch is rotatably mounted in the notch, the supporting member is perpendicular to the loading member and defines a first opening and a second opening at opposite ends thereof, the first opening faces the loading member, the pivot portion is rotatably mounted on the second opening.

4. The punching device of claim 2, wherein a distance between the pivot portion and an end portion of the linkage end is greater than a distance between the pivot portion and an end portion of the driving end.

5. The punching device of claim 4, wherein each of the pair of linkage members defines a sliding groove thereof, a profile of the sliding groove overlaps a trace of the linkage end rotating around the pivot portion, the linkage end is slidably sandwiched between the pair of linkage members and movably received in the sliding grooves.

6. The punching device of claim 5, wherein the sliding groove comprises a containing portion and a resisting portion at opposite ends thereof, when the resisting portion resists the linkage end of the rotating member, the rotating member is capable of rotating to drive the punch.

7. The punching device of claim 6, each of the pair of the linkage members defines a first linkage hole and a second linkage hole; among the sliding groove, the first linkage hole and the second linkage hole, the first linkage hole is located far away from the loading member, the second linkage hole is located far away from the supporting member, the first connecting rod is connected to the pair of linkage members via the second linkage holes.

8. The punching device of claim 7, wherein the base further comprises a pair of fixing members mounted on the supporting member away from the loading member, the pressure arm comprises a drive rod and a handle fixed to the driving rod, the drive rod is rotatably mounted on the pair of fixing members.

9. The punching device of claim 8, wherein the drive rod comprises a rotating portion, a drive portion and an exerting portion at opposite ends of the rotating portion, the drive portion and the exerting portion cooperatively define an obtuse angle, the rotating portion is rotatably mounted on the pair of fixing members, the exerting portion is connected to the pair of linkage members via the first linkage holes.

10. The punching device of claim 9, wherein a distance between the rotating portion and an end of the drive portion is greater than a distance between the rotating portion and an end of the exerting portion.

11. A punching device, comprising:

a base comprising a loading member and a supporting member mounted on the loading member;

a linkage assembly comprising at least one linkage member, a rotating member, a first connecting rod, a second connecting rod and a third connecting rod, wherein the rotating member is rotatably mounted on the supporting member, the at least one linkage member is movably mounted on the rotating member, a first end of the first connecting rod is rotatably connected to the linkage member, a second end of the first connecting rod opposite to the first end thereof is rotatably connected to a middle portion of the second connecting rod, the second connecting rod is rotatably connected to the supporting member and the third connecting rod by opposite ends thereof;

a carrying assembly comprising a carrying block and a resilient module received in the carrying block, wherein the carrying block is movably supported by the loading member, the resilient module is rotatably connected to the third connecting rod;

a punch mounted on an end of the rotating member; and a pressure arm rotatably connected to the supporting member and the linkage member, wherein when an external force is applied to the pressure arm to rotate, the pressure arm drives the carrying block to position a workpiece via the linkage assembly, then compresses the resilient module and rotates the rotating member to drive the punch to punch workpieces.

12. The punching device of claim 11, wherein the carrying block defines a pair of guiding grooves and a receiving space therebetween, the resilient module comprises a dragging rod arranged in the middle of the receiving space, an end of the dragging rod movably passing through the carrying block and is rotatably connected to the third connecting rod.

13. The punching device of claim 11, wherein the resilient module further comprises a connecting member, a pair of pushing rods and a pair of resilient members, a middle portion of the connecting member is perpendicular mounted on the dragging rod, the pair of pushing rods is arranged at two sides of the dragging rod and parallel to each other, an end of the pushing rod is connected to the connecting member, the other end of the pushing rod movably passing through the carrying block, the pair of resilient members is sleeved on the pair of pushing rods respectively.

14. The punching device of claim 13, wherein opposite ends of each of the pair of resilient members resists the connecting member and the carrying block from an inner side, the base further comprises a pair of guiding rails mounted on the loading member, the pair of guiding rails is received in the pair of guiding grooves to enable the carrying block to slide on the loading member toward the supporting member.

15. The punching device of claim 11, wherein the rotating member comprises a pivot portion, a driving end and a linkage end extending from opposite ends of the pivot portion, the pivot portion is rotatably mounted on the supporting member, the linkage end is movably connected to the linkage member, the punch is mounted on the driving end.

16. The punching device of claim 15, wherein the driving end comprises a pair of bars parallel to each other and defines a notch therebetween, the punch is rotatably mounted in the notch, the supporting member is perpendicular to the loading member and defines a first opening and a second opening at opposite ends thereof, the first opening faces the loading member, the pivot portion is rotatably mounted on the second opening.

17. The punching device of claim 15, wherein a distance between the pivot portion and an end portion of the linkage end is greater than a distance between the pivot portion and an end portion of the driving end.

18. The punching device of claim 17, wherein each linkage member defines a sliding groove thereof, a profile of the sliding groove overlaps a trace of the linkage end rotating around the pivot portion, the linkage end is slidably connected to the linkage member and movably received in the sliding groove.

19. The punching device of claim 18, wherein the sliding groove comprises a containing portion and a resisting portion at opposite ends thereof, when the resisting portion resists the linkage end of the rotating member, the rotating member is capable of rotating to drive the punch.

20. The punching device of claim 19, each of the linkage member define a first linkage hole and the second linkage hole; among the sliding groove, the first linkage hole and the second linkage hole, the first linkage hole is far away from the loading member, the second linkage hole is far away from the supporting member, the first connecting rod is connected to the linkage member via the second linkage hole.

* * * * *